US005788615A

United States Patent [19]

Jones

[11] Patent Number: 5,788,615

[45] Date of Patent: Aug. 4, 1998

[54] BODY EXTENSION EXERCISE MACHINE

[75] Inventor: Gary A. Jones, Falmouth, Ky.

[73] Assignee: Hammer Strength Corporation, Cincinnati, Ohio

[21] Appl. No.: 594,526

[22] Filed: Jan. 31, 1996

[51] Int. Cl.[6] ..... A63B 21/08; A63B 23/04

[52] U.S. Cl. ..... 482/97; 482/98; 482/134; 482/137

[58] Field of Search ..... 482/92–94, 97, 482/98, 133–138, 142, 52, 53

[56] References Cited

U.S. PATENT DOCUMENTS

| | | | |
|---|---|---|---|
| D. 321,390 | 11/1991 | Jones . | |
| 2,472,391 | 6/1949 | Albizu | 482/94 |
| 2,542,074 | 2/1951 | Bierman | 482/80 |
| 4,169,589 | 10/1979 | McArthur | 482/135 |
| 4,511,137 | 4/1985 | Jones | 482/142 |
| 4,902,007 | 2/1990 | Ferrari | 482/97 |
| 5,106,080 | 4/1992 | Jones . | |
| 5,106,081 | 4/1992 | Webb | 482/137 |
| 5,135,457 | 8/1992 | Caruso | 482/137 |
| 5,254,067 | 10/1993 | Habing et al. . | |
| 5,263,914 | 11/1993 | Simonson et al. | 482/137 |
| 5,366,432 | 11/1994 | Habing et al. | 482/138 |
| 5,445,583 | 8/1995 | Habing . | |
| 5,484,365 | 1/1996 | Jones et al. | 482/137 |
| 5,554,090 | 9/1996 | Jones | 482/137 |

OTHER PUBLICATIONS

AMF American, catalog, Strength and Conditioning—Leg Development, pp. 8 and 9, 1981.

Chattanooga Group, Inc., Alliance Rehab Leg Press promotional flyer, 1994.

Cybex New Product Release, Squat Press, May 1994.

Hammer Strength Picture Price List, Oct. 1994.

*Primary Examiner*—Richard J. Apley
*Assistant Examiner*—Victor K. Hwang
*Attorney, Agent, or Firm*—Wood, Herron & Evans, L.L.P.

[57] ABSTRACT

A body extension exercise machine includes a frame, an elongated support connected to the frame and defining a reclined exercise position for an exerciser and a lever connected to the frame for pivotal movement about a pivot axis oriented transverse to and located below the support. A lower end of the lever includes a weight holder for holding a predetermined weight, and an upper end of lever includes a plate. When in the exercise position and reclined on the support, with at least one leg retracted and in contact with the plate, an exerciser pushes outwardly against the plate and against the held weight resistance to pivot the lever with respect to the frame from an initial at-rest position to a leg-extended position. Thereafter, the exerciser reduces the force applied to the plate and allows the lever to pivot back to the at-rest position, corresponding to the legs retracted position. This leg extension and leg retraction simulates a squat exercise, and it optimally exercises the quadriceps and hamstring muscles. In contrast to a squat, this exercise machine eliminates the well known safety hazards of a squat exercise performed with a barbell.

17 Claims, 4 Drawing Sheets

BODY EXTENSION EXERCISE MACHINE

FIELD OF THE INVENTION

This invention relates to weight training exercise equipment for exercising the leg muscles. More particularly, this invention relates to an exercise machine designed to strengthen the quadriceps and the hamstring muscles of an exerciser via performance of an exercise motion which is similar to a squat motion exercise performed with a barbell.

BACKGROUND OF THE INVENTION

Strength training has become an important part of most physical fitness regiments, whether the exerciser is attempting to build muscle mass, increase endurance and/or rehabilitate an injury. For most exercisers, strength training involves the use of one or more exercise machines which require the exerciser to perform a particular physical movement against a selected weight resistance. Initially, free weight-loaded dumbbells and barbells were the most widely used strength training devices. However, due in large part to safety concerns, various other types of exercise machines have been developed which enable an exerciser to perform a prescribed exercise motion against a selected weight resistance wherein the motion is dictated by the structure of the exercise machine. Most of these exercise machines employ a weight holding hub or a selectorized weight stack, thereby to allow the exerciser to select the weight resistance.

In the last seven or eight years, applicant has enjoyed tremendous success in developing numerous different exercise machines which, compared to earlier exercise machines, are better adapted to accommodate the natural musculoskeletal structure of a human exerciser. These exercise machines are covered by numerous issued U.S. patents, and the assignee of this invention sells these patented exercise machines under the trademark Hammer Strength®. Primarily because of their biocompatability, their durability and their improved safety, these exercise machines are well known throughout the world by those involved in the health club and the strength training industry.

Most of applicant's exercise machines incorporate the principle of providing a weight resistance against a natural motion of a body part, such as an arm or a leg. In a sense, applicant designs and builds the machines around the body of the exerciser, with a particular exercise movement in mind. In this way, sometimes two or more of applicant's exercise machines may appear somewhat similar in structure and/or function, but the exercise motions defined by the different machines are all different. Stated another way, each of applicant's exercise machines works a particular muscle group in a different way.

Despite the ongoing development by multiple entities of different exercise machines to accommodate different exercise motions, some of which developments seem to mimic the efforts of applicant, there still seem to be some exercise motions or maneuvers which have not yet been simulated sufficiently by an exercise machine to warrant complete replacement of the basic, free weight-loaded barbell. For instance, exercise maneuvers such as those commonly referred to as the "dead" lift and the "squat" (most often included in the free weight and the powerlifting categories of strength training) are among these exercise motions which heretofore have not been sufficiently simulated or improved upon by an exercise machine. When performed properly, the squat is an excellent exercise for working the quadricep muscles and hamstring muscles of an exerciser.

In performing a squat exercise with a weight plate-loaded barbell, the barbell is held behind the neck of the exerciser, extending across the back of the exerciser at about the tops of the shoulder blades. The exerciser usually lifts the barbell off a supporting rack and then lowers the barbell by bending at the knees and waist, while looking upwardly, until a lower, or legs-retracted, position is achieved.

The amount of leg retraction, or flex, depends on how low the exerciser wishes to go. For a deep squat, the tops of the thighs should be at least parallel with the floor. After the exerciser is at the lower, retracted-leg position, the exerciser then raises the barbell by extending upwardly to a standing position, thereby straightening the legs and the waist. During lowering and raising of the barbell, the weight resistance held thereby is primarily felt by the legs of the exerciser, and most notably by the quadriceps and hamstring muscles.

Because of the manner of holding the barbell during a squat, and due to the relatively heavy weight resistances typically involved, compared to many other exercises the squat represents a safety risk even if performed properly. Moreover, many exercisers do not perform the squat properly, because the barbell is held in the wrong place (usually too high on the back and too close to the rear of the head), and/or because the exerciser bends too far forward at the waist when lowering the barbell. Either situation can cause serious injury to the exerciser's back.

Another limitation of the squat, or with all barbell exercises, is that safety reasons dictate against performing the exercise while alone in a workout facility. If an exerciser is working to exhaustion, or failure, or the exerciser is attempting a "maximum" weight, even a modest amount of caution would require the use of at least two persons as "spotters", at opposite ends of the barbell.

Performance of a leg press exercise motion enables an exerciser to achieve some of the benefits of a squat exercise performed with a free weight-loaded barbell. A number of leg press exercise machines are currently commercially available, including the leg press exercise machine described in applicant's U.S. Pat. No. 5,106,080, entitled "Leg Press Exercise Machine." This particular leg press exercise machine provides excellent exercise benefits for an exerciser performing a natural leg press exercise motion from a seated, or torso-flexed, body position.

However, this exercise machine is not designed to work the same muscle group in the same way as would be exercised via performance of a traditional squat exercise motion, wherein the body is almost completely extended at the end of the exercise motion.

SUMMARY OF THE INVENTION

It is an objective of this invention to better simulate a squat exercise motion via the use of an exercise machine.

It is another objective of this invention to provide an exercise machine which affords maximum muscular benefit via performance of a squat-like exercise motion, but with substantially reduced safety risk.

The present invention achieves the above-stated objectives with an exercise machine which enables an exerciser to perform a squat-like exercise motion, in effect a body extension exercise motion, from a substantially reclined position.

While reclined on an elongated support, the feet of an exerciser engage a plate located above one end of the platform. The plate is connected to an upper end of a pivotal lever, and the lower opposite end of the lever is weighted to provide a selected weight resistance. By applying force against the plate via the feet, the exerciser extends the legs from an initial legs-retracted position to a substantially horizontal legs-extended position. This places the body of the exerciser in a fully extended position, parallel to the support. Thereafter, by reducing the force applied against the plate via the feet, the lever pivots back so that the legs of the exerciser return to the initial legs-retracted position.

All this time, the weight resistance held at the lower end of the lever is felt by the legs of the exerciser via engagement of the feet with the plate. Also, during leg extension and retraction, the exerciser remains reclined on the elongated horizontal support, with the torso stationary.

With this body extension exercise machine, an exerciser does not have to hold a weighted barbell behind the neck to exercise the quadriceps and hamstring muscles. Thus, this exercise machine represents a tremendous safety advantage over the traditional manner of performing a squat exercise with a hand-held barbell.

Also, because of the orientation of the support, the plate and the lever, use of this body extension exercise machine enables an exerciser to achieve optimum muscular benefit for the leg muscles, particularly the quadriceps and the hamstrings, via performance of a leg extension and retraction motion very similar to a traditional squat exercise.

According to a preferred embodiment of the invention, a body extension exercise machine includes a frame with a slightly declined, elongated support which supports an exerciser in a reclined position. A lever pivotally connects to the frame about a horizontal pivot axis located below a first, lower end of the support, and an angled plate connects to an upper end of the lever and is located above the first end of the support. At least one weight holder connects to a lower end of the lever, beneath the pivot axis and the support.

By applying force to the plate, the plate pivots away from the support and downwardly from an initial, at-rest position, about the pivot axis. When the force is reduced or removed, the plate returns to the initial at-rest position.

The frame further includes stop mechanisms for limiting pivotal movement of the lever with respect to the frame, and thereby defining the initial at-rest position for the lever. This at-rest position corresponds to a legs-retracted position for an exerciser reclined on the support with one or more feet engaging the plate. Because of the lever structure and its location with respect to the pivot axis, when the weight holder of the lever holds no weighted plates, the force which must be applied to the plate in order to pivot the lever is relatively low. This low "start up" resistance greatly facilitates rehabilitation efforts for an exerciser, due to the ability to exercise against and accurately quantify relatively low weight resistances.

The frame also includes a shoulder brace located at the second, upper end of the support and a first, bottom brace located adjacent the lower first end of the support. These braces help to position the exerciser in the proper exercise position on the support. Moreover, the shoulder brace is adjustable along the support, thereby to accommodate exercisers of different torso length. Preferably, the shoulder brace includes a pair of opposing handles to facilitate movement thereof relative to the support. These handles are also helpful for an exerciser to grasp and hold onto during performance of the body extension exercise motion. The bottom brace preferably is secured to and pivots with the lever, and it provides a safety feature by enabling the exerciser to initially pivot the lever slightly so that at the beginning and end of the exercise, both legs are not subjected to the full weight resistance of the lever while in the legs-retracted position.

The frame also includes steps to enable an exerciser to easily climb onto the frame and into the exercise position on the support, with three steps located on each side of the machine. On each side, two lower steps are secured to connectors which form part of the lower end of the lever, and a third upper step is located directly thereabove. On each side, the two lower steps pivot with the lever, while the third upper step remains stationary.

These and other features of the invention will be more readily appreciated in view of the following detailed description and the drawings.

DETAILED DESCRIPTION OF THE INVENTION

Figure 1:
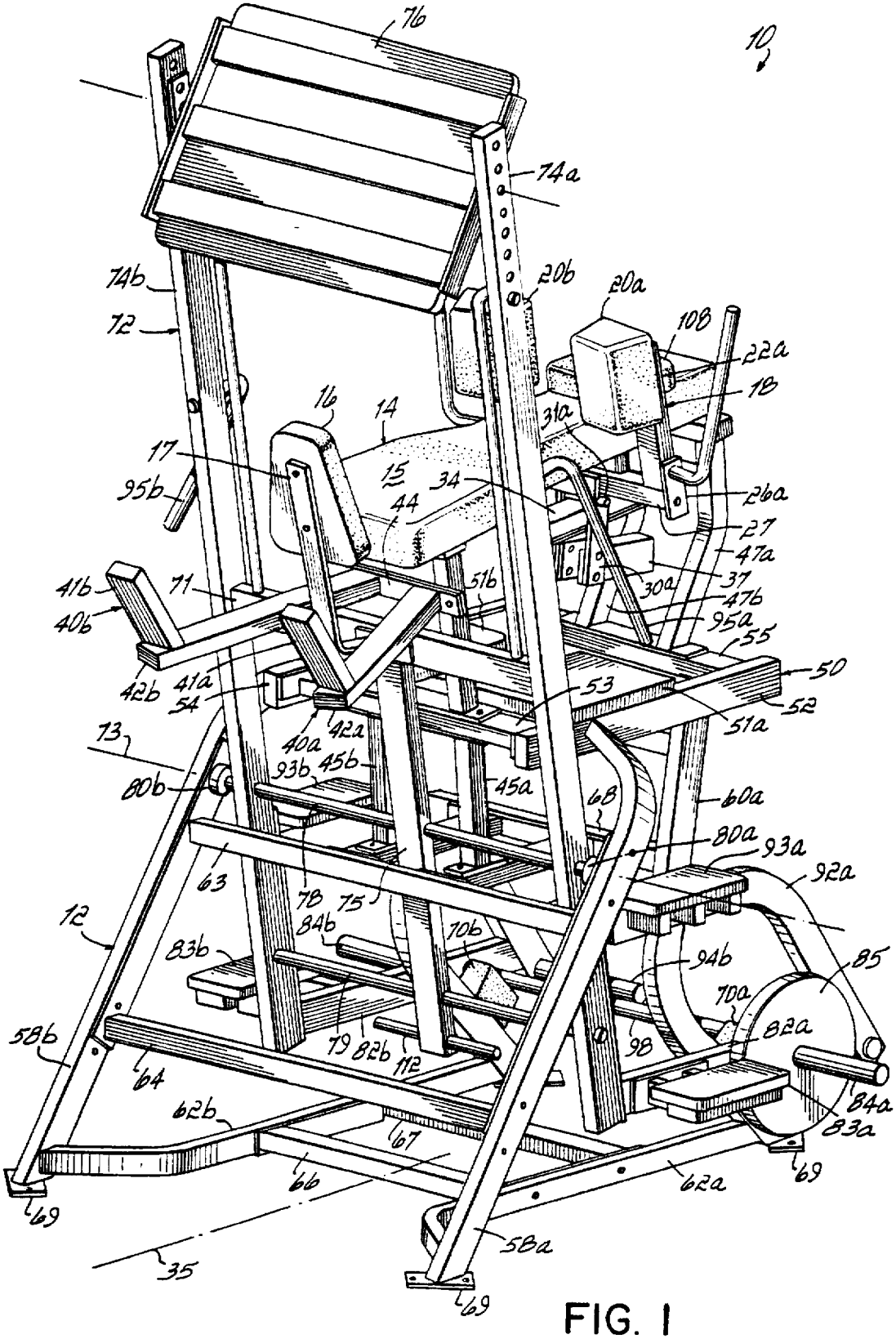
FIG. 1 is a front corner perspective view of a body extension exercise machine constructed in accordance with a preferred embodiment of the invention.

FIG. 1 shows a front corner perspective view of a body extension exercise machine 10 constructed in accordance with a preferred embodiment of the invention. This body extension exercise machine 10 includes a frame 12 of bent, welded and connected pieces of twelve gauge steel, thereby to provide a heavy duty structure for supporting an exerciser during performance of an exercise motion which involves relatively heavy weights. The frame 12 includes an elongated support 14, which is preferably padded and declines somewhat from horizontal, with a first end 15 thereof being the lower end. A first brace 16, again preferably a pad, is mounted adjacent the first end 15, and the first brace 16 is supported by a bent bracket 17. Generally, in this description the front end 15 is referred to as the forward direction with respect to the machine 10, while the opposite end of the support 14 is considered rearward thereof, or in the rearward direction.

At an opposite, or second end of the support 14, a shoulder brace 18 is mounted so as to be movable with respect to support 14, thereby to accommodate exercisers of different size. The shoulder brace 18 preferably includes a pair of spaced pads **20*a* and 20*b* located on opposite sides of the support 14, with the pads 20*a* and 20*b* secured to uprights 22*a* and 22*b*, respectively. The pads 20*a* and 20*b* may be angled inwardly, if desired. Bent handles 24*a* and 24*b* also connect to the uprights 22*a* and 22*b*, respectively, and these handles 24*a* and 24*b* have mounting plates 26*a*, 26*b*** secured at their bottom ends, respectively.

Figure 2:
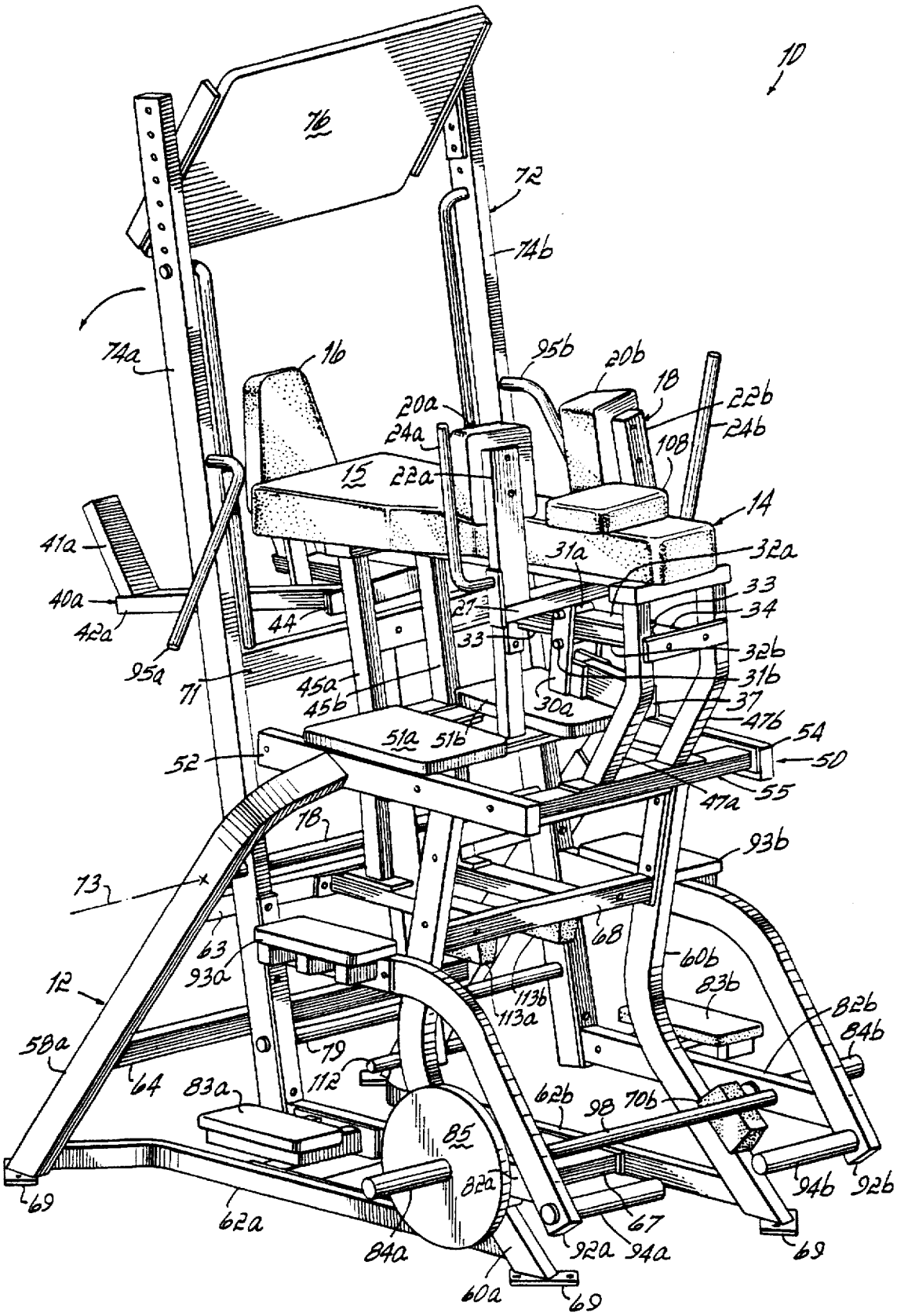
FIG. 2 is a rear corner perspective view of the body exercise machine shown in FIG. 1.
Figure 4:
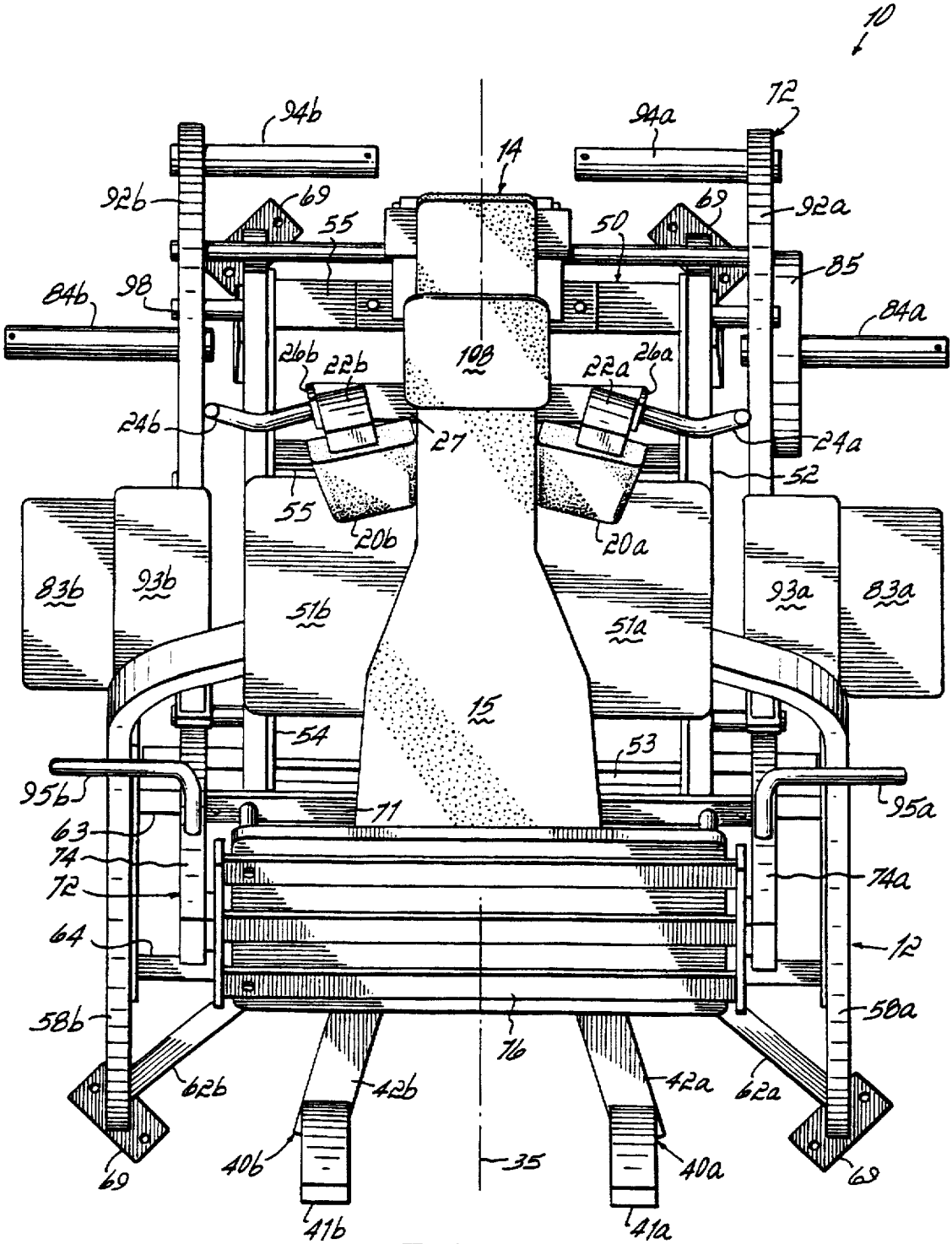
FIG. 4 is a plan view of the body extension exercise machine of FIG. 1.

A cross member 27 extends between the two uprights **22*a* and 22*b*. A pair of spaced parallel plates 30*a* and 30*b* extend vertically downwardly from the cross member 27, and these plates 30*a* and 30*b* are interconnected via a pair of horizontal spaced rods 31*a* and 31*b* (best shown in FIG. 2). These rods 31*a* and 31*b* engage the top and bottom surfaces 32*a* and 32*b*, respectively, of a rigid member 34 which extends along a vertical midplane 35 (FIG. 4) bisecting the exercise machine 10. Preferably, the rods 31*a* and 31*b* engage the surfaces 32***a* and 32*b* of rubber-friction plates 33 mounted to the top and bottom of the member 34. A counterweight 37 connected to the bottoms of the spaced plates 30*a* and 30*b* holds the rods 31*a* and 31*b* in engagement with the surfaces of the member 34.

By grasping the handles 24*a* and 24*b* and tilting the shoulder brace 18 relative to the support 14, rods 31*a* and 31*b* move out of frictional engagement with the member 34, thereby permitting movement of the shoulder brace 18 along the support 14 to a desired position. Once the handles 24*a* and 24*b* are released, the rods 31*a* and 31*b* again engage the member 34 to hold the shoulder brace 18 in the desired position.

Adjacent the first end 15 of the support 14, the frame 12 also includes leg rests 40*a* and 40*b*. More specifically, each of the leg rests 40*a* and 40*b* comprises an angled outer member, 41*a* or 41*b*, connected to an elongated member, 42*a* or 42*b*, respectively. Members 42*a* and 42*b* connect to a cross brace 44, and opposing ends of the cross brace 44 are secured to forward uprights 45*a* and 45*b*. Similarly, at the opposite end of the support 14, a second set of rearward uprights 47*a* and 47*b* support the second end of the support 14 above an intermediately located platform 50 of the frame 12. The platform 50 is defined by a pair of spaced upper steps 51*a* and 51*b* located on opposite sides of the support 14, and four rigid members 52, 53, 54 and 55 connected in a rectangular fashion to define a substantially horizontal plane below the support 14.

Below the platform 50, the frame 12 includes a pair of spaced forward base members 58*a* and 58*b* and a pair of spaced rearward base members 60*a* and 60*b*. Lower ends of the base members 58*a*, 58*b*, 60*a* and 60*b* connect to bottom support members 62*a* and 62*b*, respectively, with the bottom support members 62*a* and 62*b* being generally parallel to and on opposite sides of the midplane 35. As depicted in FIGS. 1–4, forward spanning members 63 and 64 interconnect the base members 58*a* and 58*b*. Lower base support members 66 and 67 interconnect bottom support members 62*a* and 62*b*, and rearward spanning member 68 interconnects to rearward base members 60*a* and 60*b*, near their bottoms. At each of the forward and rearward ends of the bottom support members 62*a* and 62*b*, the machine 10 preferably includes a welded plate 69. Together, these four welded plates 69 support the machine 10 and facilitate mounting of the machine 10 during shipment. On the rearward sides of rearward base members 60*a* and 60*b*, near their bottoms, the exercise machine 10 includes stop members 70*a* and 70*b*, respectively.

For the most part, the preceding portion of the detailed description sets forth the structural components which remain stationary during performance of the body extension exercise. To provide this body extension and retraction motion, the frame 12 further includes a pivotal lever 72 which is connected to the frame 12 for pivotal movement with respect thereto about a pivot axis 73, which is oriented horizontally and located below the front end 15 of the support 14. More specifically, the lever 72 includes a pair of spaced members 74*a* and 74*b* located on opposite sides of the midplane 35. Upper ends of the members 74*a* and 74*b* are interconnected via a plate 76. The members 74*a* and 74*b* are also interconnected along the pivot axis 73 via an axle 78 and adjacent bottom ends thereof via a support bar 79. At the ends of the axle 78, the lever 72 is pivotally connected to the frame 12 via a pair of spaced bearings 80*a* and 80*b*. These bearings 80*a* and 80*b* are preferably of the type identified in applicant's previously issued patents, and/or presently pending applications, although other bearing types would also be suitable. A spanning member 71 connects the members 74*a* and 74*b* below the elongated members 42*a* and 42*b*. The first brace 16 connects to the spanning member 71, so that the first brace 16 rotates with the lever 72. A midplane brace 75 interconnects with the spanning member 71, the axle 78 and the support bar 79.

The plate 76 is preferably reinforced for stability and is angled with respect to the members 74*a* and 74*b*, at an angle of about 40°. Because the members 74*a* and 74*b* are declined from vertical somewhat when the lever 72 is in an initial at-rest position, preferably at an angle of about 12°, in the at-rest position the plate 76 declines from vertical toward the support 14, (at an angle of about 28°). The plate 76 is engaged by the feet of an exerciser (FIG. 3) to extend and then retract the legs, thereby to pivot the lever 72 with respect to the frame 12, and to arcuately move the plate 76 in a direction forwardly and downwardly, followed by return to the initial position. If desired, the plate 76 may be removably connected to the upper ends of spaced members 74*a* and 74*b*, so that it can be adjusted to accommodate different leg lengths of exercisers.

At the lower ends of the spaced members 74*a* and 74*b* of the lever 72, a pair of spaced connectors 82*a* and 82*b* extend rearwardly in a substantially horizontal orientation, and bottommost steps 83*a* and 83*b* are rigidly secured to these connectors 82*a* and 82*b*, respectively. At outer ends of these connectors 82*a* and 82*b*, the machine 10 includes a pair of first weight holders 84*a* and 84*b*, respectively, and each of these weight holders 84*a* and 84*b* is adapted to hold a selected number of removable weight plates 85, as shown in the Figures. If desired, rather than weighted plates 85, the lever 72 may be configured to work against or be restrained by a weight resistance provided by a selectorized weight stack. Stated another way, the manner of applying the weight resistance to the lever 72 is not critical to the invention, so long as a resistance to movement is provided.

As shown in the Figures, the first weight holders 84*a* and 84*b* are preferably hubs which extend outwardly from the midplane 35. Additionally, the rearward ends of connectors 82*a* and 82*b* connect to bottom rearward ends of a second, upper pair of spaced connectors 92*a* and 92*b*. Similar to lower connectors 82*a* and 82*b*, the upper connectors 92*a* and 92*b* also rigidly support steps 93*a* and 93*b*. By successfully stepping on step 83*a*, grasping opposing handrails 95*a* and 95*b*, step 93*a* and then platform 51*a* along one side of the machine 10, or corresponding steps 83*b*, 93*b* and 51*b* on an opposite side of the machine, an exerciser may move upwardly to the support 14.

The upper connectors 92*a* and 92*b* also include a second pair of weight holders 94*a* and 94*b*, which are again preferably hubs. The weight holders 94*a* and 94*b* extend inwardly toward the midplane 35 and are adapted to hold one or more weighted plates 85. A connector bar 98 interconnects the connectors 82*a* and 82*b*, and when the lever 72 is in an initial at-rest position, the connector bar 98 engages the stop members 70*a* and 70*b*, thereby limiting pivotal movement of the lever 72 with respect to the frame 12. Stated another way, interaction of the connector bar 98 with the stops 70*a* and 70*b* defines the initial at-rest position.

Figure 3:
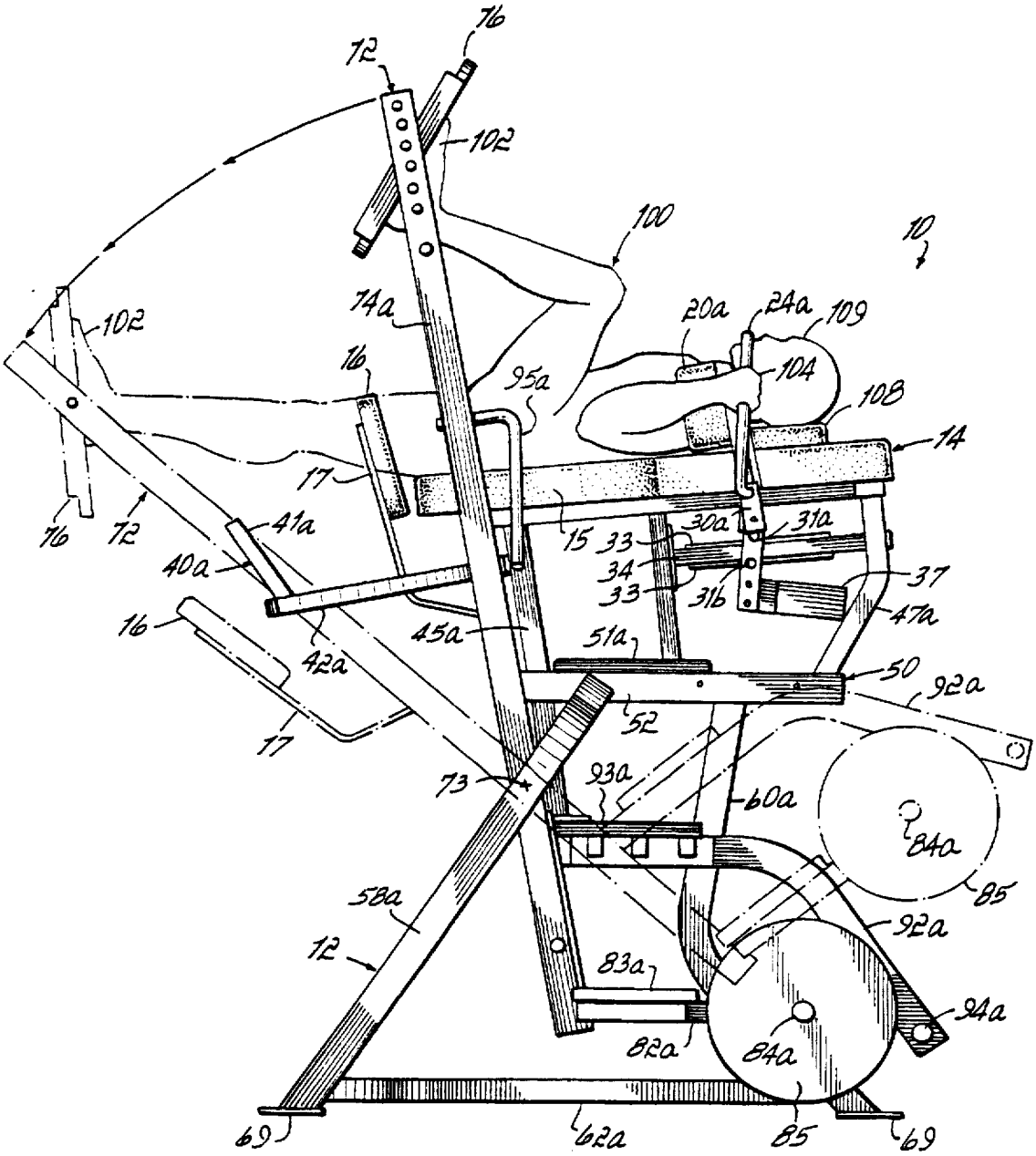
FIG. 3 is a side view of the body extension exercise machine of FIG. 1, showing an exerciser with at least one leg in a leg-retracted position (solid lines) and with at least one leg in a legs-extended position (phantom line) in accordance with the principles of the invention.

FIG. 3 best shows operation of the exercise machine 10 in accordance with the present invention. In FIG. 3, an exerciser 100 is shown in a reclined position on the support 14, with the lever 72 in the initial at-rest position, and at least one foot 102 of the exerciser 100 residing in engagement with the plate 76 with at least one leg in a leg-retracted position. The hands 104 of the exerciser grasp the handles 24*a* and 24*b* to help the exerciser 100 maintain his or her position on the support 14 and also to help hold the shoulder brace 18, particularly the pads 20*a* and 20*b* thereof, in engagement with the shoulders (not shown) of the exerciser 100. Also, it may be preferable to provide an extra headrest pad 108 to support the head 109 of the exerciser 100. In this position, the first brace 16 resides between the legs of the exerciser 100. Also in this position, steps 83*a*, 93*a* and 51*a* are vertically aligned and located below the support 14 and the exerciser 100 supported thereon. Generally, the weight holders 84*a*, 84*b*, 94*a* and 94*b* are located below the head 109 of the exerciser 100.

FIG. 3 also shows the slight declination of support 14 toward the first end 15 thereof, and FIG. 3 also shows the decline from horizontal of plate 76 when the lever 72 is in the at-rest position. Applicant has found the relative angles of the support 14 and the plate 76 shown in FIG. 3 to be preferable at this point in time, based on feedback from exercisers and the determination of an optimum starting position for the performance of leg extension and a leg retraction motion from a reclined position. However, these angles could be varied somewhat to accommodate slightly varied orientation of other parts of the machine 10, without departing from the spirit of the invention. Perhaps the most important feature is that the torso of the exerciser 100 remains stationary and reclined on the support 14 throughout the leg extension and the leg retraction motions. Unlike prior leg press exercise machines, performed either from a substantially upright sitting position or a back to the floor position, with this exercise machine 10 when the legs are extended the body of the exerciser 100 is for the most part completely extended in a single plane, generally parallel with the support 14.

By applying an outward pressing motion to the plate 76 via one or both feet 102, the exerciser 100 pivots the lever 72 with respect to the frame 12, thereby moving the plate 76 forwardly and downwardly in an arcuate motion against the weight resistance held by the weight holders 84*a*, 84*b*, 94*a* or 94*b*, eventually to a legs-extended position, as shown in phantom in FIG. 3. Again, as mentioned above, with the legs extended, the body of the exerciser 100 is almost completely extended, or straightened out. During pivoting of the lever about the axis 73, the weighted lower end of the lever 72 raises upwardly and rearwardly as shown in FIG. 3. This moves steps 83*a* and 93*a* out of vertical alignment with upper step 51*a*.

Near a bottom end of the midplane brace 75, the lever 72 includes a crossbar 112. The crossbar 112 coacts with a pair of frame-mounted stops 113*a* and 113*b* to limit pivotal movement of the lever 72 with respect to the frame 12 in the legs-extended direction.

If FIG. 3 is turned 90° and the leg-retracted and leg-extended positions of the exerciser 100 are examined, it becomes readily apparent that use of this exercise machine 10 simulates a squat exercise performed with a barbell held behind the neck. However, because of the orientation of the feet 102 with respect to the plate 76 and the final leg-extended position, it is not quite identical to a squat motion. For that reason, applicant refers to this exercise motion as a "body extension" motion. Perhaps more importantly, based on feedback from a number of exercisers who have tried this machine, this exercise machine provides optimal exercise benefit for the quadricep and hamstring muscles during performance of the leg extension and leg retraction motions. Moreover, it provides these optimal muscular benefits in a manner which is much safer than a typical squat exercise performed with a barbell, even if the squat exercise is performed properly. With this exercise machine, safe exercise of these muscles can be achieved without the need for one or more spotters.

The Figures show that this preferred embodiment of this exercise machine 10 includes four weight holders, with each pair of weight holders located a different distance from the pivot axis 73 and angularly offset from each other. This provides the dual strength benefit disclosed in applicant's co-pending U.S. patent application Ser. No. 08/255,058, entitled "Exercise Machine With Variable Strength Curve Capability" filed on Jun. 7, 1994, which is expressly incorporated by reference herein in its entirety.

Another aspect of this machine which differs from a squat exercise is that leg extension is performed first, followed by leg retraction. In contrast, with a squat performed from a standing position, the weight is lowered first and then raised back upwardly to the original position. One problem associated with performing a squat with a barbell is that an exerciser may well be able to lower a relatively heavy weight to the retracted position but then be unable to raise it back up to the original position. That places the exerciser in a dangerous position and will require the immediate assistance of at least two alert and attentive spotters. Some of these problems are eliminated by the fact that, with this exercise machine 10, the torso of the exerciser does not move at all during the exercise. It remains stationary.

In contrast, with this exercise machine 10, the exerciser 100 will not need spotters in the first place. Moreover, if the weight resistance is too great to be exercised against, the exerciser 100 will not be able to initially extend the legs from the legs-retracted position. Stated another way, the exerciser learns that the weight resistance is too great before putting himself or herself in a dangerous position. Also, if it is necessary to make initial movement of the lever easier, on a relative scale, this exercise machine 10 provides a dual strength curve capability, due to weight holders which are angularly offset and located different distances from the pivot axis 73.

Finally, as noted previously, the front brace 16 provides some degree of assistance for the exerciser 100 at the beginning and the end of an exercise with this machine 10. By placing one foot on the brace 16 and pushing outwardly, the exerciser 100 can start pivotal motion of the lever 72 from the initial at-rest position. This eliminates the need to use both legs to begin the exercise motion by pushing from a legs maximally retracted position, which can be a rather difficult position for starting and stopping the exercise motion, particularly for an exerciser with bad knees who does not wish to perform the extension exercise from such a fully or deeply retracted position, i.e. a deep squat.

While a body extension exercise machine in accordance with a preferred embodiment of the invention has been described, it is to be understood that the invention is not limited thereby and that in light of the present disclosure, various other alternative embodiments will be readily apparent to one of skill in the art without departing from the scope of the invention. Accordingly, applicant intends to be bound only by the following claims.

I claim:

1. A body extension exercise machine comprising:

a frame;

an elongated support connected to the frame for supporting an exerciser in a substantially horizontal reclined exercise position;

a lever pivotally connected to the frame and pivotal about a pivot axis oriented horizontally and transversely to the elongated support, the pivot axis located below the support, the lever further having first and second ends located above and below the support, respectively;

a weight holder operatively connected to the second end of the lever for holding a predetermined weight resistance, thereby to resist pivotal movement of the lever with respect to the frame about the pivot axis from an at-rest position; and a plate mounted at the first end of the lever for engagement by at least one foot of an exerciser reclined on the support in the exercise position, with at least one leg of the exerciser being in a substantially retracted position when the corresponding foot is in engagement with plate and the lever is in the at-rest position, so that upon application to the plate, via the at least one foot, of an outwardly directed pressing motion the exerciser extends the leg outward to a substantially horizontal leg-extended orientation so that the torso and the at least one of the legs are oriented at about 180° and the plate is oriented substantially perpendicular to the elongated support, thereby pivoting the lever about the pivot axis from the at rest position to a leg extended position against the predetermined weight resistance in a body extension motion to exercise the muscles of the leg.

2. The body extension exercise machine of claim 1 wherein the lever further comprises two spaced members located on opposing sides of the support and the plate is connected between upper spaced first ends of the spaced members, the plate being of sufficient dimension to permit engagement and outward pressing motion by two feet of the exerciser, thereby to exercise both legs of the exerciser.

3. The body extension exercise machine of claim 1 wherein the lever, when in the at rest position, is declined from vertical in a direction opposite the support.

4. The body extension exercise machine of claim 1 wherein the second end of the lever is nearer the pivot axis than the first end of the lever.

5. The body extension exercise machine of claim 1 wherein the weight holder further comprises:

a weight holding hub operatively connected to the second end of the lever.

6. The body extension exercise machine of claim 1 wherein the weight holder further comprises:

a first weight resistance means spaced a first distance from the pivot axis; and a second weight resistance means spaced a second distance from the pivot axis, the first and second distances being unequal, the first and second weight resistance means also being angularly offset, thereby to provide a dual strength curve capability.

7. A body extension exercise machine comprising:

a frame;

an elongated support connected to the frame for supporting an exerciser in a substantially horizontal reclined exercise position;

a lever pivotally connected to the frame and pivotal about a pivot axis oriented horizontally and transversely to the elongated support, the pivot axis located below the support, the lever further having first and second ends located above and below the support, respectively;

a weight holder operatively connected to the second end of the lever for holding a predetermined weight resistance, thereby to resist pivotal movement of the lever with respect to the frame about the pivot axis from an at-rest position; and a plate mounted at the first end of the lever and declined at an angle toward the support for engagement by at least one foot of an exerciser reclined on the support in the exercise position, with at least one leg of the exerciser being in a substantially retracted position when the corresponding foot is in engagement with plate and the lever is in the at-rest position, so that upon application to the plate, via the at least one foot, of an outwardly directed pressing motion the exerciser extends the leg outward to a substantially horizontal leg-extended orientation so that the torso and the at least one of the legs are oriented at about 180° and the plate is oriented substantially perpendicular to the elongated support, thereby pivoting the lever about the pivot axis from the at rest position to a leg extended position against the predetermined weight resistance in a body extension motion to exercise the muscles of the leg.

8. A body extension exercise machine comprising:

a frame;

an elongated support connected to the frame for supporting an exerciser in a substantially horizontal reclined exercise position;

a lever pivotally connected to the frame and pivotal about a pivot axis oriented horizontally and transversely to the elongated support, the pivot axis located below the support, the lever being declined from vertical in a direction opposite the support in an at-rest position, the lever further having first and second ends located above and below the support, respectively;

at least one stop mechanism secured to the frame and adapted to coact with the lever to limit further pivotal movement with respect to the frame, thereby to define the at-rest position of the lever;

a weight holder operatively connected to the second end of the lever for holding a predetermined weight resistance, thereby to resist pivotal movement of the lever with respect to the frame about the pivot axis from the at-rest position; and a plate mounted at the first end of the lever for engagement by at least one foot of an exerciser reclined on the support in the exercise position, with at least one leg of the exerciser being in a substantially retracted position when the corresponding foot is in engagement with plate and the lever is in the at-rest position, so that upon application to the plate, via the at least one foot, of an outwardly directed pressing motion the exerciser extends the leg outward to a substantially horizontal leg-extended orientation so that the torso and the at least one of the legs are oriented at about 180° and the plate is oriented substantially perpendicular to the elongated support, thereby pivoting the lever about the pivot axis from the at rest position to a leg extended position against the predetermined weight resistance in a body extension motion to exercise the muscles of the leg.

9. A body extension exercise machine comprising:

a frame;

an elongated support connected to the frame for supporting an exerciser in a substantially horizontal reclined exercise position;

a lever pivotally connected to the frame and pivotal about a pivot axis oriented horizontally and transversely to the elongated support, the pivot axis located below the support, the lever further having first and second ends located above and below the support, respectively;

a first brace located at a first end of the support and mounted to and pivoting with the lever;

a shoulder brace located at a second end of the support and spaced away from the lever, the first and shoulder braces cooperatively confining the torso of an exerciser therebetween when the exerciser is reclined on the support in an exercise position;

a weight holder operatively connected to the second end of the lever for holding a predetermined weight resistance, thereby to resist pivotal movement of the lever with respect to the frame about the pivot axis from an at-rest position; and a plate mounted at the first end of the lever for engagement by at least one foot of an exerciser reclined on the support in the exercise position, with at least one leg of the exerciser being in a substantially retracted position when the corresponding foot is in engagement with plate and the lever is in the at-rest position, so that upon application to the plate, via the at least one foot, of an outwardly directed pressing motion the exerciser extends the leg outward to a substantially horizontal leg-extended orientation so that the torso and the at least one of the legs are oriented at about 180° and the plate is oriented substantially perpendicular to the elongated support, thereby pivoting the lever about the pivot axis from the at rest position to a leg extended position against the predetermined weight resistance in a body extension motion to exercise the muscles of the leg.

10. The body extension exercise machine of claim 9 and further comprising:

means for adjusting the shoulder brace along the support, thereby to accommodate exercisers of different torso length.

11. The body extension exercise machine of claim 10 wherein the adjusting means further comprises:

a pair of spaced shoulder pads located on opposite sides of the support; and a pair of spaced handles located on opposite sides of the support.

12. The body extension exercise machine of claim 9 wherein the first brace is mounted to and pivots with the lever.

13. A body extension exercise machine comprising:

a frame;

an elongated support connected to the frame for supporting an exerciser in a substantially horizontal reclined exercise position, the support having an exerciser bottom supporting portion located adjacent the lever and a head supporting portion spaced away therefrom;

a lever pivotally connected to the frame and pivotal about a pivot axis oriented horizontally and transversely to the elongated support, the pivot axis located below the support, the lever further having first and second ends located above and below the support, respectively;

a weight holder operatively connected to the second end of the lever for holding a predetermined weight resistance, thereby to resist pivotal movement of the lever with respect to the frame about the pivot axis from an at-rest position;

a connector extending between the second end of the lever and the weight holder, so that the weight holder is located substantially below the head supporting portion of the support; and a plate mounted at the first end of the lever for engagement by at least one foot of an exerciser reclined on the support in the exercise position, with at least one leg of the exerciser being in a substantially retracted position when the corresponding foot is in engagement with plate and the lever is in the at-rest position, so that upon application to the plate, via the at least one foot, of an outwardly directed pressing motion the exerciser extends the leg outward to a substantially horizontal leg-extended orientation so that the torso and the at least one of the legs are oriented at about 180° and the plate is oriented substantially perpendicular to the elongated support, thereby pivoting the lever about the pivot axis from the at rest position to a leg extended position against the predetermined weight resistance in a body extension motion to exercise the muscles of the leg.

14. The body extension exercise machine of claim 13 and further comprising:

a first step secured to the connector in substantially horizontal orientation; and at least one additional step secured to the frame and vertically aligned with the first step, the steps facilitating movement of the exerciser to and from the support.

15. A body extension exercise machine for performing a squat-like exercise motion from a reclined exercise position comprising:

a frame;

an elongated support secured to the frame and oriented along a vertical midplane which bisects the frame, the support defining a substantially horizontal reclined exercise position for supporting an exerciser thereon in a substantially horizontal reclined position, facing upwardly;

a weighted lever pivotally connected to the frame and pivotal about a horizontal pivot axis located below the support, the pivot axis oriented perpendicular to the midplane, the lever further including a pair of spaced members located on opposite sides of the midplane, the spaced members having first upper ends located above the support and second lower ends located below the support, the second lower ends being weighted to provide a predetermined resistance to pivotal movement of the lever about the pivot axis, the members being declined downwardly from vertical in a direction away from the support when the lever is in an initial at-rest position; and a plate connected to the lever between the first ends of the spaced members, the plate declined downwardly from vertical at an angle toward the support when the lever is in the at-rest position, the plate adapted to be engaged by one or both feet of an exerciser located in the reclined exercise position, with one or both legs of the exerciser in a substantially retracted position when the corresponding one or both feet are in engagement with the plate and the lever is in the at-rest position, so that the one or both legs are extendable from the substantially retracted position toward a leg-extended substantially horizontal position via application of an outwardly directed motion similar to a squat exercise motions, whereby the leg extension motion pivots the lever about the pivot axis from the at rest position and arcuately moves the plate along the midplane in a direction downward and away from the support against the predetermined resistance so that the torso of the exerciser and the one or both legs in engagement with the plate form an angle of about 180°, thereby to exercise the one or both legs of the exerciser.

16. The body extension exercise machine of claim 15 wherein the pivot axis is nearer the second lower ends of the spaced members than the first upper ends of the spaced members.

17. The body extension exercise machine of claim 15 and further comprising:

a connector bar interconnecting the second lower ends of the spaced members, the connector bar located below the support and coacting with the frame to limit pivotal movement of the plate toward the platform, thereby to define the at rest position.

* * * * *